United States Patent [19]

Gallo et al.

[11] Patent Number: 5,003,442

[45] Date of Patent: Mar. 26, 1991

[54] MOVABLE LIGHTING APPARATUS

[75] Inventors: Fred J. Gallo, Scarsdale, N.Y.; James S. Crossley, Randolph, Vt.

[73] Assignee: Jeremiah J. Harris Associates, Inc., Cornwall-on-Hudson, N.Y.

[21] Appl. No.: 517,761

[22] Filed: May 2, 1990

[51] Int. Cl.[5] ..... F21S 3/00

[52] U.S. Cl. ..... 362/225; 362/233; 362/250; 362/402; 362/418; 362/431

[58] Field of Search ..... 362/220, 225, 233, 250, 362/393, 402, 418, 431

[56] References Cited

U.S. PATENT DOCUMENTS 4,220,981 9/1980 Koether ..... 362/431 X 4,300,186 10/1981 Hurd ..... 362/431 X

*Primary Examiner*—Allen M. Ostrager

*Attorney, Agent, or Firm*—Knobbe, Martens, Olson & Bear

[57] ABSTRACT

A lighting assembly having a series of telescoping tubes is mounted in a box, and an interior spring urges the tubes to extend out of the box into a use position. A light on the free end of the tubes simulates a candle. One end of cable within the spring is connected to the free end of the tubes, and the other cable end is wound on a drum connected to a brake/motor combination. When the brake is released, the cable unwinds and the tubes extend in response to the urging of the spring. When the tubes are to be retracted, the motor winds the cable back onto the drum. A group of assemblies are mounted in the box and their cable drums controlled by a common drive shaft. Drums of different diameters are provided to determine the extension of the cables, and hence the tubes, to thereby provide lighting fixtures of different heights.

20 Claims, 3 Drawing Sheets

MOVABLE LIGHTING APPARATUS

FIELD OF THE INVENTION

This invention relates to lighting apparatus which is particularly adapted for use in a road show theater operation, wherein it is necessary that the light fixture be movable while being operated during a show, and yet the overall apparatus be readily portable from one theater to the next.

BACKGROUND OF THE INVENTION

For theater sets, it is frequently desirable that electric lighting in the form of simulated candles be provided, and it is desirable that the lighting arrangements be quickly installed or moved into a scene, and then quickly removed. In one currently successful show, this is accomplished by assembling lighting fixtures that are fully erected beneath the floor of the stage, and the entire fixture is raised and lowered through a door in the floor as needed. In some cases, it is desirable that the light supports or "candlesticks" be of different lengths, some of them approaching three feet in length. In a fixed assembly, this therefore necessitates that the fixture be lowered at least three feet below the floor. While this can be accomplished fairly economically with relatively permanent-type construction for a show that is expected to play for many months, such construction is not practical for theater runs of a short duration. In addition to the cost of building such structures, there is the further expense of shipping and handling bulky and fragile components. Further, many theater floor arrangements are such that three feet of vertical space is not available at floor levels, without significant modification.

Thus, a need exists for a lighting apparatus that can collapse into a relatively small package. Further, such apparatus must be reliable, but yet relatively inexpensive. In addition, it must be easily remotely controllable, in a rapid, repeatable manner.

SUMMARY OF THE INVENTION

The foregoing needs are provided by the lighting apparatus of this invention. A lighting fixture, or "candlestick," is provided by a group of telescoping tubes with a light positioned on the upper end of the support formed by the extended tubes A spring is positioned within the tubes urging the tubes into their extended position. A cable is positioned within the tube and one end of it is attached to the upper end of the "candlestick" while the lower end of the cable extends through the lower end of the "candlestick" and is wound onto a pulley or drum. Allowing the drum to rotate in one direction, releases the cable and allows the spring to urge the telescoping tubes into an extended position Driving the drum in the opposite direction winds the cable onto the drum, thereby retracting or telescoping the tubes.

In a preferred form of the invention, a low-voltage light is positioned on the end of the extended "candlestick," and the cable is used to telescope the tubes into a retracted position carries the electric power to the light.

In the preferred arrangement for retracting the tubes, the cable is wound onto a drum mounted on a motor-driven shaft. In a particular array of lights, it is often desirable that one "candlestick" extends to a different height than an adjacent one. The extent to which the cable is allowed to unwind, thus allowing the tubes to extend, can be readily controlled by proper selection of the diameter of the wind-up drums. That is, with a large-diameter drum, a greater linear length of cable is unwound in one revolution than with a small-diameter drum mounted on the same drive shaft. In this manner, an array of "candles," all controlled by the same drive shaft, can be raised or lowered as a group by way of a common control. Any number of different arrays can be simultaneously used.

In a preferred form of the invention, the bottom tube of a series of telescoping tubes is mounted within a boxlike housing, and the upper tubes are fully retractable into the housing Spring-loaded covers close the fixture openings in the housing top wall. The upper surface of the housing can be flush with a stage floor. The cable mechanism in the take-up reels or drums, together with the motor and drive shaft, are also conveniently mounted in the housing, such that the entire apparatus can be handled as a unit for shipment, storage and installation, it being only necessary to make the needed electrical connection for powerinq and controlling the motor and the lights. Conveniently, the common drive shaft and a conductor in the retracting cable can be utilized for conducting a lowvoltage electricity to the light.

In accordance with the method of the invention, a group of retractable lights are provided by positioning a series of tubes in telescopic relation, and positioning a spring within the tubes to urge the tubes into an extended position. By positioning a cable within the tube connected to the extended end of the tube, the tubes may be retracted. Preferably, this is accomplished by winding the cable onto a drum. Conversely, the tubes are allowed to extend by allowing the retracting cable to unwind. The method further includes selecting the diameter of the windup drums to determine the desired linear movement of the cable during one revolution of the drum whereby the extension heights of the tubes can be selectively determined by selecting the desired drum diameter.

DETAILED DESCRIPTION OF THE PREFERRED EMBODIMENT

Figures 1, 4:
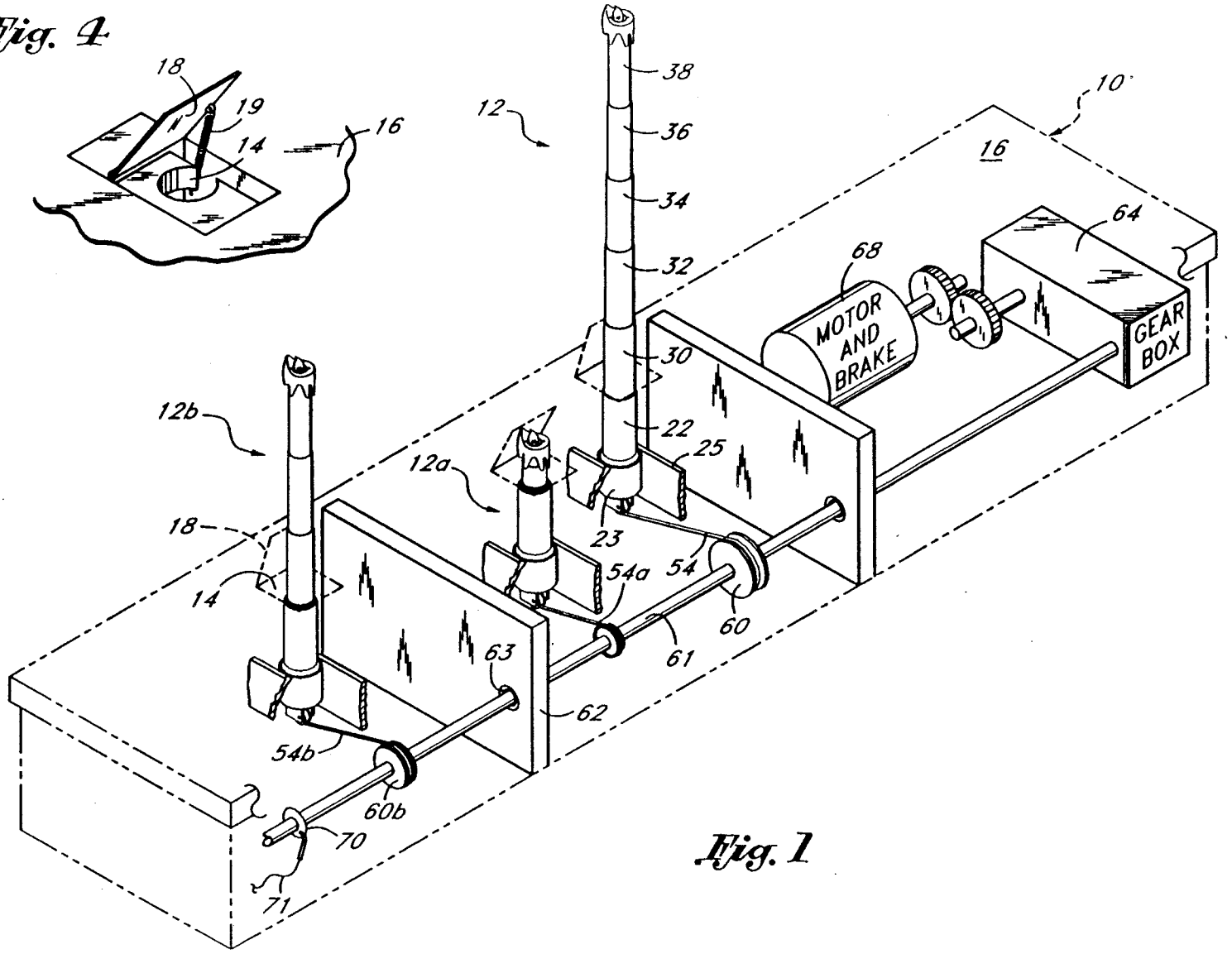
FIG. 1 is a perspective, schematic view of lighting apparatus incorporating the invention.
FIG. 4 is a fragmentary view, schematically illustrating the door and spring over an opening in the subfloor through which a "candle" extends.

Referring now to FIG. 1, there is schematically illustrated an elongated, generally rectangular or oblong box or housing 10. A plurality of extendable light assemblies 12 are mounted in the box, each aligned with an opening 14 in the top wall 16 of the box 10. Each opening is closable by a cover or door 18, which is normally urged closed by gravity or a spring 19 (FIG. 4) A magnet may be provided for holding the cover closed.

Figure 2:
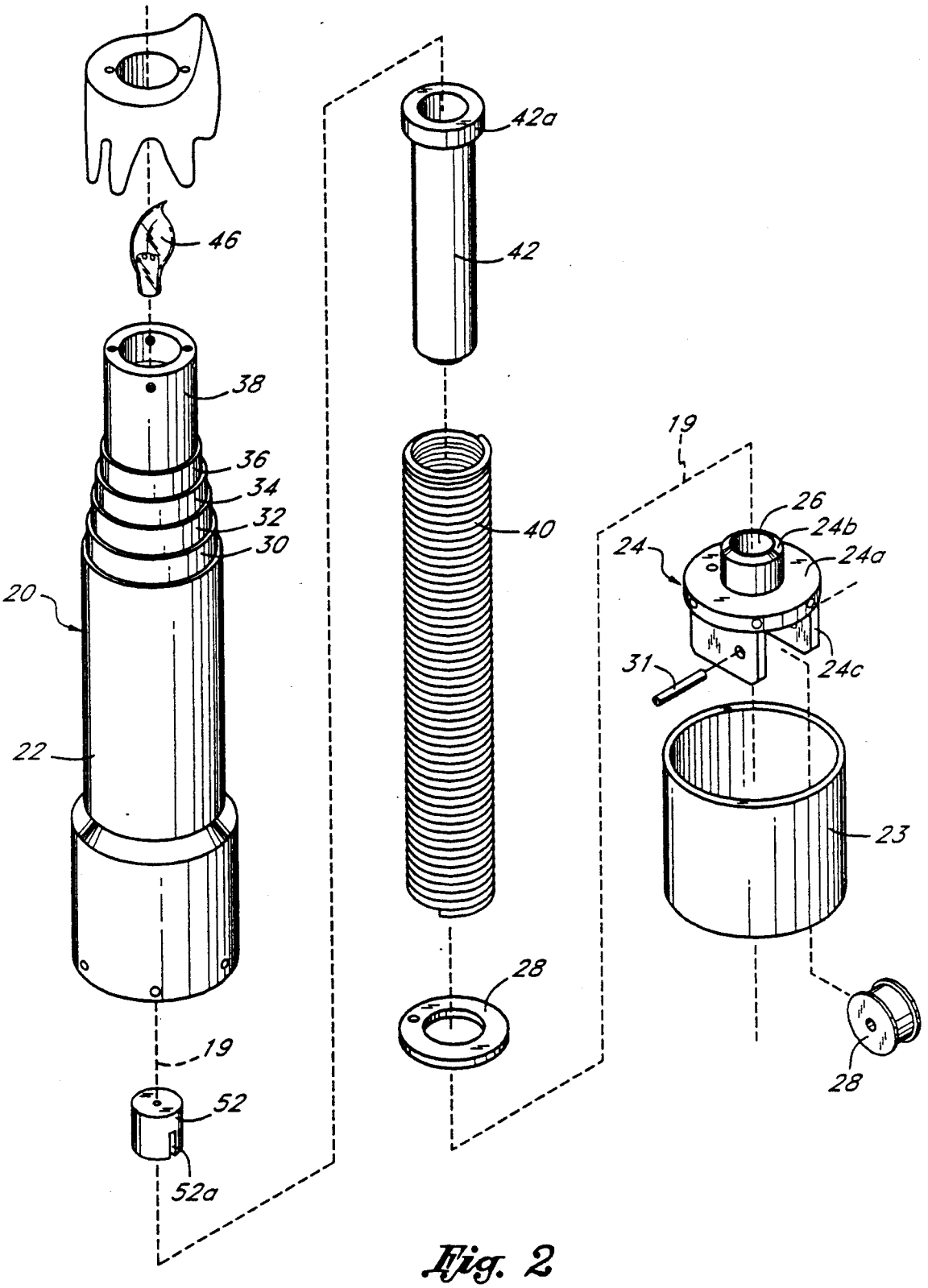
FIG. 2 is an exploded perspective view of one of the light fixtures of the apparatus of FIG. 1.
Figure 3:
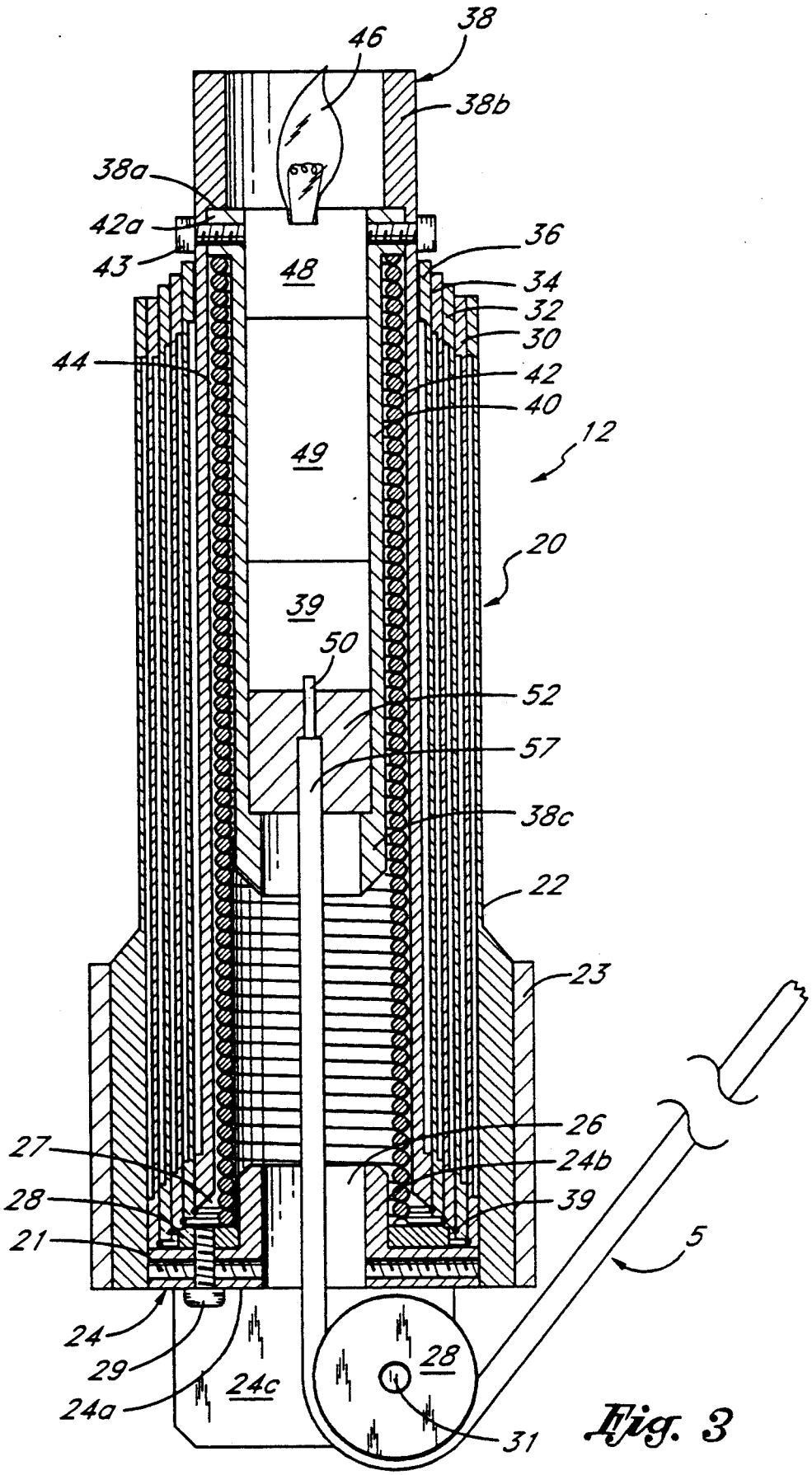
FIG. 3 is a cross-sectional view of one telescoping assembly with the telescoping tubes in a retracted position.

Referring to FIGS. 2 and 3, as well as FIG. 1, it may be seen that each lighting assembly 12 includes a plurality of tubes 20 adapted to be telescoped within each other. The tubes include a base or bottom end tube 22, which is secured to a surrounding sleeve 23 having legs 25 welded or attached by other suitable means to the bottom wall of the box 10. The tube 22 has positioned in its lower end a bottom plug 24, which includes a centrally located disk-shaped portion 24*a* that fits within the lower end of the tube 22. The plug is held in that position by a plurality of fasteners 21 extending radially through holes in the lower end of the base tube 22 and thread into the plug. These fasteners also secure the sleeve 23 to the tube 22. Depending from the plug disk-shaped portion 24*a*is a pair of spaced lugs 24*c* which straddle a central opening 26 in the plug. The lugs support a pulley 28 mounted on a pin 31 extending horizontally between the lugs and perpendicular to the vertical axis 19 of the tubes 20. The pulley is located off center with respect to the base tube 22 such that the vertical axis 19 of the tubes is tangential to the periphery of the pulley, as seen in FIG. 3.

The plug 24 further includes an inner, vertically upstanding tubular portion 24*b*, which defines in its interior the opening 26 and defines on its exterior, in combination with the lower end of the tube 22 inner wall, an annular space 27. The plug 24, as well as the tubes 22, are preferably made of suitable plastic, electrically non-conductive material, such as that material sold under the trademark DELRIN TM. A brass grounding washer 28 is positioned in the lower end of the annular space 27 resting on the upper surface of the plug disk portion 24*a*. A brass grounding screw 29 extends through the plug disk 24*a* and threads into a hole in the washer 28.

The group of tubes 20 further includes, positioned within the base tube 22, a series of concentrically positioned tubes 30, 32, 34, 36 and 38, of respectively decreasing diameters. The main body portions of these tubes are spaced from the adjacent tubes, but the ends of the tubes are flanged or thickened to form slide bearing surfaces and to hold the tubes together as a unit when they are extended More specifically, the upper end of the outer tube 22 has a flange or thickened portion, while the lower end of the next radially inner tube 30 has a thickened portion which is flanged or offset outwardly. The result of this is that the tubes, when being extended or retracted, slide smoothly on these thickened portions, and the flange of the upper end of the outer tube 22 engages with the flange on the lower end of the tube 30 to limit the upward movement of the tube 30 with respect to the tube 22. Similarly, the upper ends of the tubes 30, 32, 34 and 36 are flanged inwardly, like the upper end of the outer tube 22, and the lower ends of the tubes 30, 32, 34, 36 and 38 are flanged outwardly to cooperate with the flanged upper ends when the tubes are extended The tubes 30, 32, 34 and 36 are each provided with a groove on the lower end of its inner surface to receive a retaining ring, one of which is shown at ring 39, to hold the tubes together as a unit.

Positioned within the upper end of the inner tube 38 is a short electrically-conductive, preferably aluminum tube or cup 42. The cup has an outwardly extending flange 42*a* on its upper end that is positioned adjacent to a shoulder 38*a*, formed by an inwardly thickened wall 38*b* of the upper end of the inner tube 38. The cup 42 is held in position by a series of fasteners 43 extending through the wall of the tube 38 and into the cup flange 42*a*. The portion of the cup extending below the flange is spaced from the inner wall of the tube 38, thus defining an elongated annular space 44.

A coil spring 40 is positioned within the inner tube 38, with the lower end of the spring engaging the brass washer 28 and being positioned in the lower annular space 27 with the outer surface of the plug portion 24*b*, functioning as a guide for the spring. The upper end of the spring fits within the annular space 44 and engages the flange 38*a*.

An electric light or bulb 46, schematically illustrated, is positioned in the upper end of the tube 38 with the lamp base being positioned in a suitable socket 48 in the cup 42. Although a single bulb is illustrated, various illumination sources may be utilized In a prototype, three bulbs are being used, one permanent and two being cycled off and on to simulate a flame. Beneath the bulb receptacle there is a schematically illustrated integrated circuit component 49 for controlling the cycling of the bulbs. Beneath the component 49 is an electrical connector 39, which cooperates with an electrical conductor 50.

Positioned in the lower end of the cup 36 is a cylindrical insulator member or retainer 52 which is confined within the cup by engaging an inwardly extending flange 38*c* on the lower end of the cup. A cable 54 for retracting the tubes 20 is attached to retainer 52 by way of the cable extending into a transverse slot 52*a* formed in the lower end of the retainer, while the central conductor 50 in the cable extends through a hole in the retainer 52 and is electrically connected to the connector 39 and hence the circuit board 49 and the lamp 46. The cable central conductor 50 is preferably made of stainless steel, and a surrounding plastic sheath 57 that preferably has a somewhat rectangular, but chain-like, exterior. After the conductor is inserted through the hole in the retainer, it is crimped to securely attach the conductor to the retainer. Also, the plastic sheath 57 is wedged into the slot 52*a*. The rectangular configuration of the sheath and the slot shape prevent relative rotation between those elements.

The cable 54 extends downwardly through the tubes 20, out the lower end of the tubes and around the pulley 28 attached to the lower end of the outer tube. Referring to FIG. 1, the cable is wrapped around a drum 60 mounted on a drive shaft 61, extending throughout most of the length of the box 10. The shaft is supported by spaced partitions 62 in the box 10 with suitable insulators 63 insulating the shaft from the box. The shaft on one end leads to a gear box 64, which is connected by suitable gearing to an electric motor and brake 68. The opposite end of the shaft is connected by an electric slip ring 70 to a source 71 of low-voltage electrical power. Thus, the line shaft is electrically hot and is connected in the drum 60 to the conductor 50 in each of the cables and hence, to the electric lamp 46 on the top of the lighting assembly. Preferably, the lamp requires a 9 volt supply. A suitable transformer (not shown) may be positioned in the box 10 to provide the low voltage source.

There is a separate drum 60, 60*a* or 60*b* for each cable 54, 54*a* or 54*b* of each assembly 12, 12*a* and 12*b* shown in FIG. 1 It is often desirable that the lamp supports be of different heights to simulate an array of candles. In accordance with the invention, this is conveniently accomplished by selecting the diameter of the drums to control the extent that the tubes 20 for a particular assembly can extend.

OPERATION

In use, the box 10, with its group of light assemblies 12 in a fully collapsed form, is mounted in a stage floor, with the upper wall of the box being at floor level. When it is desired that the lights be used, the brake/motor 68 is energized to release the brake in a controlled manner to permit the spring 40 in each of the assemblies to extend axially from its compressed position of FIG. 3 to urge the tubes 20 into an extended position That is, the drive shaft is released so that the cable 54 on the drum 60 can unwind, allowing the tubes 20 to extend. The cover 18 for each opening 14 is simply pushed open by the rising lighting assembly 12, against the urging of the spring 19, shown in FIG. 4.

The degree of tube extension is controlled by the diameter of each drum 60. A given rotation of the shaft 61 and each of the drums connected to it produces a given linear upward extension of a particular cable 51, and correspondingly that amount of tube extension. With a larger diameter drum, it will be appreciated that greater linear movement results than with a smaller diameter drum.

Thus, in the schematic arrangement shown in FIG. 1, the drum 60 has a larger diameter than the drum **60*b*, and hence the rotation of the shaft 61 has allowed the tubes for assembly 12 to extend fully, while only three tubes are extended for assembly 12*b*. Correspondingly, the pulley 60*a* is smaller than the pulley 60*b* and only one tube is extended for assembly 12*a*. As an example in a prototype system, pulley 60 might have a 3.75 inch diameter and permit tube extension of 25 inches, whereas the pulley 60*b* might have a diameter of 2 inches and provide tube extension of about 14 inches, and pulley 60*a* diameter might be 0.75 inches and provide about 6** inches of extension.

Low-voltage electrical power is also applied to the line shaft by means of a slip ring 70, thereby energizing the conductor 50 in each of the cables 54 and thus energizing the lamps 46 on the top of the lighting assemblies 12. The extension spring 40 is electrically connected to the support cup 42 at the top of the assembly, and likewise the other end of the spring is electrically connected to ground by way of the brass washer 28 and its fastener 29. Thus, the spring functions to complete the electrical circuit.

When the lighting is to be removed from view on the stage, the motor 68 is energized, causing the drive shaft 61 to rotate in the opposite direction, thereby winding the cables 54 onto the drums 60 and retracting the tubes 20 to the stored position. When the tubes are retracted, a spring 19 for each of the doors urges the doors closed. As the tubes are withdrawn, the lamps are de-energized. The power to the motors and to the lamps can, of course, be controlled by a central, computerized control, and any number of boxes filled with lamp assemblies can be employed. The number of light assemblies in each box is normally greater than that illustrated in Figure to better suggest a group of candles, but for simplicity, only three are shown.

With the lamps 46 in a retracted position, the entire box 10 can be easily disconnected from its power supply and removed from its position in the stage floor and shipped to a new location, where it can be similarly mounted. Thus, there is no assembly and disassembly of the tubes, lights, control cables, etc. of a particular assembly.

Compactness is another advantage of the system. The telescoping tubes can be varied by varying the height of the tube sections and by varying the number of tubes In a version of the system planned for production, the individual tubes are about six inches in height. When retracted, the tubes plus the lamp, plus the pulley structure beneath the tube assembly is only about eight inches in depth. The extended tubes raise to a height of almost three feet, with the portion extending above the top of the box being about two and a half feet. In such an example, the extension spring must be capable of collapsing to about six inches in length and be able to extend to about thirty-two inches with sufficient force to raise the tubular lighting assembly.

While a preferred form of the invention has been disclosed, it will be understood that various changes in modifications can be made that will still fall within the scope of invention.

What is claimed is:

1. Lighting apparatus comprising:

a plurality of telescoping tubes forming a tubular support;

a spring within the tubes urging the tubes into a fully extended position;

a light on an upper end of said support; and a cable attached to said end for retracting said tubes against the urging of said spring into a retracted position.

2. The apparatus of claim 1 wherein:

said cable extends within said support and through a lower end of said support for connecting to means for pulling on the cable and restraining the cable.

3. The apparatus of claim 1, wherein said cable includes an electrical conductor connected to said light.

4. The apparatus of claim 1, including:

a rotatably mounted windup drum connected to said cable for winding the cable on the drum to retract said tubes.

5. The apparatus of claim 4, including a drive shaft on which said drum is mounted, the diameter of said drum being selected to control the extent to which said tubes can extend such that with a large diameter drum allowing said cable to be extended a sufficient amount to allow the tubes to be fully extend, whereas with a small diameter drum the tubes are only allowed to extend a lesser amount for a given amount of rotation of the drum.

6. The apparatus of claim 4, wherein said telescoping tubes together with said spring, said light, said cable, and said drum constitute a lighting assembly, and said apparatus includes a plurality of said assemblies, a drive shaft, connected to rotate the drum of each of said assemblies; said assemblies being connected to said drive shaft in a manner to allow the tubes of each of said assemblies to extend differing amounts to thereby provide supports of different heights.

7. The apparatus of claim 6, wherein the drums of at least two of said assemblies are of different diameter, resulting in the tubes of said assemblies extending differing amounts.

8. The apparatus of claim 6, including a box for enclosing and supporting said assemblies with the telescoping tubes of said assemblies extending vertically and being completely positioned within said box when fully retracted, and said telescoping tubes being adapted to extend from said box when the tubes are extended.

9. The apparatus of claim 8, including an opening in an upper wall of said box for each of said assemblies, a cover for said opening, said spring being sufficiently strong to extend said tubes and to open said cover.

10. The apparatus of claim 1 wherein said spring has a plurality of coils concentrically positioned in said tubes, and said cable extends through said coils.

11. Lighting apparatus comprising:

a plurality of collapsible lighting assemblies being urged into an extended position;

a cable for each assembly connected to retract said assembly into a collapsed position;

a drive shaft; and a drum mounted on said shaft for each of said assemblies, the cable for each assembly being connected to be wound on a respective one of said drums to retract said cables, the diameter of each of said drums being selected to provide a predetermined linear movement of the respective cable in each of said assemblies controlling the extension of each said assemblies.

12. The apparatus of claim 11, including a housing in which said assemblies are positioned in retracted position together with said drive shaft and said drums.

13. The apparatus of claim 11, including a light on each of said assemblies, and wherein the cable for each of said assemblies includes an electrical conductor connected to said light.

14. The apparatus of claim 11, wherein each of said lighting assemblies includes a plurality of telescoping tubes and a spring within said tubes urging the tubes to extend, and said cable is connected to retract the tubes.

15. A method of providing a retractable lighting support, comprising:

providing a series of tubes in telescopic relation, positioning a spring within said tubes to urge said tubes into an extended position forming a support;

positioning a cable within said tube and connecting one end of the cable to an extendable end of said support and connecting the other end of the cable to a cable winding mechanism for retracting said tubes or permitting said tubes to be extended in response to the urging of said spring.

16. The method of claim 15, including attaching said cable to a drum in said winding mechanism, and selecting the diameter of the drum to determine the desired linear movement of said cable whereby the extension of said tubes is determined.

17. A method of raising and lowering a lighting assembly comprising:

positioning a light on an end of a tube which is the end tube of a series of telescoped tubes;

urging the tubes into an extended position with a spring mounted in the tubes;

pulling on the end tube with a cable in the tube to retract the tubes into a telescoped position; and releasing the cable a predetermined amount to allow said spring to extend the tubes to a desired height.

18. The method of claim 17, wherein said pulling is accomplished by winding the cable onto a drum.

19. A method of raising and lowering a plurality of lights using the method of claim 18, including mounting the drum of each lighting assembly on a common drive shaft so that said lights may be raised and lowered as a group.

20. The method of claim 19, including mounting said tubes, drums, and drive shaft in a box which may be easily mounted in an opening in a stage floor, the box and the tubes being dimensioned such that the tubes are completely in the box when the lights are fully retracted and a free end of said tubes extends out of the box when the tubes are extended.

* * * * *